United States Patent [19]

Griesenbeck

[11] Patent Number: 4,852,598

[45] **Date of Patent: * Aug. 1, 1989**

[54] BED TENT

[76] Inventor: Harrell Griesenbeck, 2502 St. Andrews Dr., Ennis, Tex. 75119

[ * ] Notice: The portion of the term of this patent subsequent to May 27, 2003 has been disclaimed.

[21] Appl. No.: 98,537

[22] Filed: Sep. 18, 1987

Related U.S. Application Data

[63] Continuation-in-part of Ser. No. 867,778, May 27, 1987, abandoned, which is a continuation of Ser. No. 604,847, Apr. 27, 1987, Pat. No. 4,590,956.

[51] Int. Cl.[4] ..... E04H 15/36; E04H 15/40; A47C 29/00; A47G 9/02

[52] U.S. Cl. ..... 135/102; 5/414; 5/494

[58] Field of Search ..... 5/113, 414, 493, 494, 5/508; 135/96, 102, 104, 116; 52/2

[56] References Cited

U.S. PATENT DOCUMENTS

| | | | |
|---|---|---|---|
| 1,014,848 | 1/1912 | Reinert | 5/414 X |
| 2,325,097 | 7/1943 | Behringer | 5/494 X |
| 2,357,056 | 8/1944 | Nelson | 5/113 X |
| 2,475,515 | 7/1949 | Potter | 135/104 |
| 2,931,373 | 4/1960 | Larson | 135/96 X |
| 3,800,814 | 4/1974 | Hibbert | 135/104 X |
| 4,222,400 | 9/1980 | Reimer | 135/104 X |
| 4,237,914 | 12/1980 | Gantz | 5/508 X |
| 4,386,439 | 6/1983 | Roccograndi et al. | 5/493 X |
| 4,491,141 | 1/1985 | Eppenbach | 5/414 X |
| 4,556,391 | 12/1985 | Tardivel et al. | 135/104 X |
| 4,590,956 | 5/1986 | Griesenbeck | 135/104 X |

FOREIGN PATENT DOCUMENTS

| | | | |
|---|---|---|---|
| 0085270 | 10/1983 | European Pat. Off. | 52/2 |
| 8009749 | 6/1981 | France | 135/104 |
| 444761 | 3/1936 | United Kingdom | 135/102 |

*Primary Examiner*—Robert A. Hafer
*Assistant Examiner*—D. Neal Muir
*Attorney, Agent, or Firm*—Kanz, Scherback & Timmons

[57] ABSTRACT

A bed tent with a base portion snugly fitted around a mattress and a canopy portion connected to the base portion along its lower periphery is supported in an upright position over the mattress to provide an enclosure having a bottom surface area substantially coextensive with the surface area of the mattress and an opening for ingress and egress.

6 Claims, 2 Drawing Sheets

BED TENT

CROSS-REFERENCES TO RELATED APPLICATIONS

This is a continuation-in-part of application Ser. No. 06/867,778 filed May 27, 1987 (now abandoned) which was a continuation of application Ser. No. 604,847 filed Apr. 27, 1984 which issued as U.S. Pat. No. 4,590,956 on May 27, 1986.

BACKGROUND OF THE INVENTION

1. Field of the Invention

This invention relates to tents. More particularly, it relates to tents adapted to be fitted over and secured to a conventional mattress. The tents of the invention are adaptable for either indoor or outdoor use and can be employed with any of several types of conventional mattresses including, for example, innerspring mattresses, foam mattresses, air mattresses, water beds and the like. The tents of the invention are preferably portable and adapted to be easily erected and collapsed by a single individual.

2. Description of the Related Art

Portable tents are well known and can be used for many different purposes. Tents generally comprise one or more walls adapted to be erected in some fashion so as to create an enclosure for the user. Tents adapted for use outdoors generally comprise a floor or bottom portion adapted to maintain cleanliness inside the tent and to protect the user from the dampness of the underlying earth. Such tents are typically anchored to the earth by means of pins or spikes and are supported by a network of interconnected poles, rods or braces. Once the user has erected such a tent at the intended use site, cots and/or mattresses are thereafter placed inside the tent for use in sleeping. Although waterproofed canvas has been a frequently used material of construction in years past, a variety of synthetic fibers and reinforced polymeric materials have more recently been used for making such tents.

Tents primarily intended for indoor use are also well know. Such tents are especially popular as children's toys and may or may not incorporate a floor or bottom portion. Because tents intended for indoor use cannot generally be anchored to the flooring which supports them, such tents typically comprise a network of frame members defining the perimeter of the tent base in addition to frame members employed to maintain the upper portion of the tent in an upright position.

Another class of conventional enclosures which are frequently referred to as "tents" include oxygen tents, mosquito nets and the like which are typically draped over a framework which is either suspended above or supported over the intended user.

Although the conventional tents referred to above have many beneficial advantages, numerous deficiencies and disadvantages have been encountered during their use. For example, tents adapted for indoor use as children's toys require floor space which may be at a premium, especially in relatively small apartments or residences.

SUMMARY OF THE INVENTION

According to the present invention, a bed tent is provided which comprises an upright canopy portion including an opening for ingress and egress by the user and a bottom portion adapted to engage a conventional mattress. In one embodiment, a bed tentis provided which comprises a bottom portion adapted to be fitted around a conventional mattress and a canopy portion adapted to be supported above the mattress by a framework comprising diagonally disposed flexible frame members. Similarly, a bed tent may also be provided which comprises a canopy portion with the base of the canopy adapted to extend around the sides of a mattress and which includes elastomeric means for removeably fastening the base of the canopy thereto.

The invention may, of course, be in the form of a children's toy comprising a tent with a base portion adapted to be quickly and easily fit around the mattress of a child's bed with the canopy portion disposed over and connected to the base portion so as to form an enclosure over the child's bed and means for providing ingress and egress.

The bed tents disclosed herein are unique means for providing privacy and protection over the bed, cot or mattress of the user. The bed tents of the invention offer an inexpensive and portable method for creating an enclosure over the bed of an individual but which occupies minimal space and requires no anchoring beyond the support provided by a conventional mattress.

BRIEF DESCRIPTION OF THE DRAWING

The apparatus of the invention is further described and explained in relation to the drawings and the detailed description set forth below. The description of the invention will be better understood by reference to the following drawing wherein.

DESCRIPTION OF THE PREFERRED EMBODIMENT

Referring to FIGS. 1, 2, 5 and 6, bed tent 10 preferably comprises base portion 12 adapted to be fitted over or around a conventional mattress and canopy portion 14 adapted to provide a substantially upright enclosure over the mattress. Base portion 12 and canopy portion 14 can be constructed of the same or different materials, depending upon intended use. When bed tent 10 is intended for interior use as a children's toy, for example, both base portion 12 and canopy portion 14 can be fabricated from conventional cotton sheeting material or the like. Where bed tent 10 is intended for outdoor use, both base portion 12 and canopy portion 14 can be constructed from water-repellent materials such as plastic, canvas, inpregnated nylong and the like. Where bed tent 10 is intended for use as an insect barrier, base portion 12 can be constructed from conventional sheeting material and canopy portion 14 can be constructed from more loosely woven material which permits the passage of light and/or air but impedes the passage of insects therethrough. If bed tent 10 is intended for use as an oxygen tent in a medical application, base portion 12 can comprise a conventional cotton sheeting material while canopy portion 14 can comprise a polymeric material which is more impervious to the passage of an oxygen-containing gas therethrough.

Figure 5:
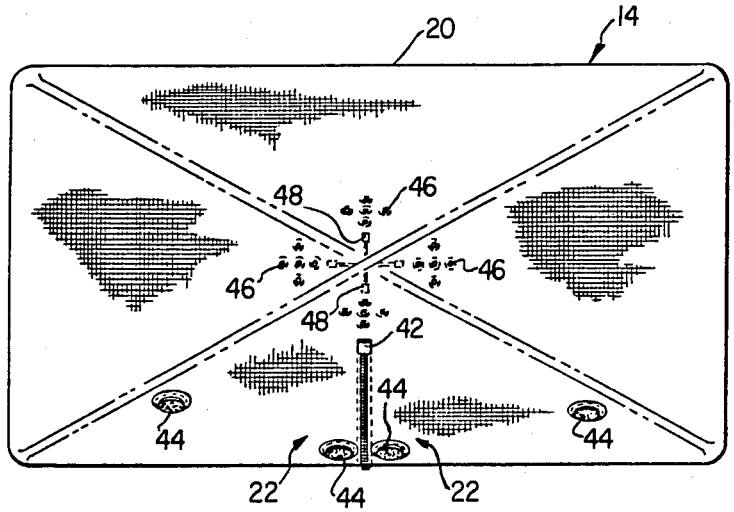
FIG. 5 is a top view depicting the bed tent of FIG. 1 with the door flaps in a closed position.

In one preferred embodiment of the invention, the lower extending perimeter of canopy portion 14 is coextensive with and connected to the uppermost edge of base portion 12. Canopy portion 14 is preferably connected to base portion 12 by seam 20 which extends around the edge 16 except for that portion of edge 16 which is beneath door flaps 22 of bed tent 10 when door flaps 22 are in their closed position as shown in FIG. 5. The manner in which base portion 12 and canopy portion 14 are connected at seam 20 can vary according to the material utilized for the construction of those respective portions, and further depending upon the intended use. Thus, for example, where base portion 12 and canopy portion 14 are both constructed of a conventional sheeting material, seam 20 may comprise conventional stitching done by hand, a sewing machine or the like. In this instance, multiple rows of stitching along seam 20 can assist in making the resultant bed tent 10 more durable and serviceable over a prolonged period.

Where base portion 12 and/or canopy portion 14 are fabricated from other materials, seam 20 may be constructed by any suitable fastening means including, for example, heat welding, zippers, rivets, brads, grommets and the like. When canopy portion 14 and base portion 12 are of the same material and floor surface 18 is eliminated, the base portion 12 and canopy 14 can be a continuous sheet material appropriately cut to perform both functions.

In addition to upwardly extending surface 18, which also serves as a floor for bed tent 10, base portion 12 preferably further comprises sides 24 and bottom edges 26. Bottom edges 26 are preferably gathered at corner 28 and are adapted to be removeably fitted around underlying mattress 30 by an elastomeric band 32 which may or may not extend continuously around the inward facing perimeter of bottom edges 26. Although the means shown in FIG. 6 for fitting base portion 12 around underlying mattress 30 is a preferred means for use in the apparatus of the invention, other similarly effective means can also be employed within a scope of the invention. Thus, for example, elastomeric straps extending transversely across mattress 30 so as to connect and draw together opposed bottom edges 26 of base portion 12 can also be used where desired. Where the tent is merely to be used as an amusement device for children, particulary infants, upwardly exterior surface 18 may be eliminated. In this case, the upper surface of the mattress comprises the floor of the tent and a substantial saving in materials of construction is realized.

Similarly, for some applications where bed tent 10 is particularly intended for outdoor use, it may be preferable to reverse base portion 12 with respect to canopy 14 so that the downward facing surface of mattress 30 would be covered by surface 18 of base portion 12 and the upward facing surface of mattress 30 would be partially exposed and would face the interior portion of bed tent 10. This embodiment might be particularly useful where base portion 12 comprises a weather repellent material which mattress 30 does not. In this embodiment door flaps 22 of canopy portion 14 would have to open sufficiently to permit mattress 30 to be inserted therein so that base portion 12 could thereafter be fitted around mattress 30.

With the preferred embodiment shown in FIGS. 1, 2, 5 and 6, however, bed tent 10 is preferably spread out over mattress 30 prior to erecting canopy portion 14 and bottom edges 26 of base portion 12 are passed over the sides and around the corners of the mattress and thereafter maintained in that position by elastomeric band 32 for as long as may be desired.

As stated above, canopy portion 14 is preferably constructed of a material having characteristics consistent with the intended use. Thus, where the passage of light and air through canopy portion 14 is desired, a more loosely woven fabric is desirably employed than if the intended function of canopy portion 14 is to repel water or provide more complete privacy for the user.

According to a preferred embodiment of the invention, canopy portion 14 is preferably reinforced at corners 36 to resist tearing of seam 20 at those locations and to provide increased support for the downward extending ends of frame members 38. Corners 36 of canopy portion 14 are desirably reinforced by means of additional layers of fabric or material which may or may not be the same as that employed as the primary material of construction for canopy portion 14. Additional stitching or other similarly satisfactory means may also be employed for reinforcing corners 36. Loops or pockets can also be stitched or otherwise fastened into corner 36 on the interior side of canopy portion 14 to assist in maintaining the downwardly extending portions of frame members 38 in their desired position relative to corners 36.

Figure 1:
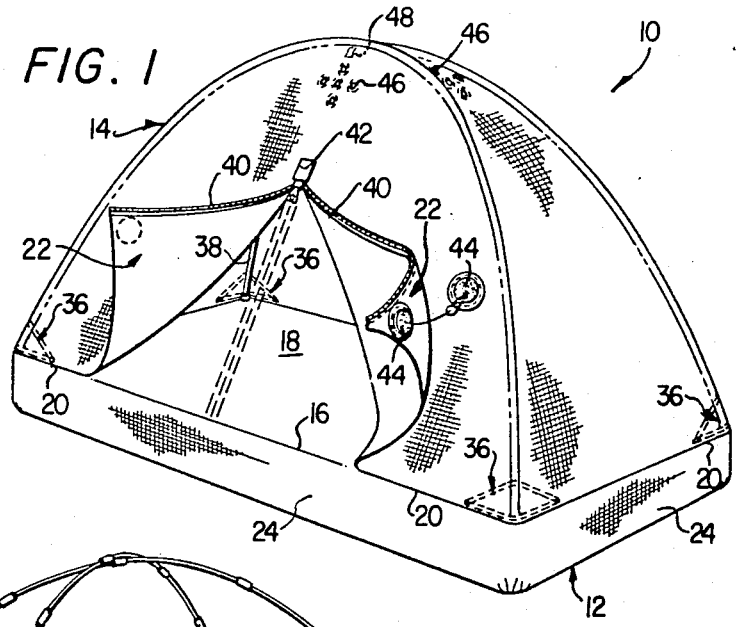
FIG. 1 depicts a perspective view of a preferred embodiment of the bed tent of the invention wherein the door flaps are open to expose a portion of the interior of the tent and wherein the path of the zipper closure for the door flaps is shown in phantom.

Canopy portion 14 also includes means for providing ingress and egress to the user. A preferred means of ingress and egress is a zippered closure similar to that depicted in FIGS. 1 and 5. Referring to FIGS. 1 and 5, canopy portion 14 is desirably severed along edges 40, thereby creating door flaps 22. A closure device such as zipper 42 can then be attached to edges 40 of door flaps 22 to permit the user to open and close door flaps 22. Although the zipper shown in FIGS. 1 and 5 is a preferred closure means for use with door flaps 22 of canopy portion 14, it will be apparent that other similarly effective closure devices including, for example, buttons, snaps, VELCRO strips, ties and the like can similarly be employed within the scope of the invention. VELCRO pads 44 are provided for maintaining door flaps 22 in the open position when zipper 42 is unzipped. However, other similarly effective means including buttons, snaps, tie backs and the like can also be employed for this purpose.

Canopy portion 14 preferably includes a plurality of apertures 46 adapted to provide ventilation to and promote air circulation through canopy portion 14. The size, number and placement of apertures 46 can vary according to the material of construction and intended use. Where the primary material used in the construction of canopy portion 14 is loosely woven, the need for apertures 46 may be aleviated.

Figure 6:
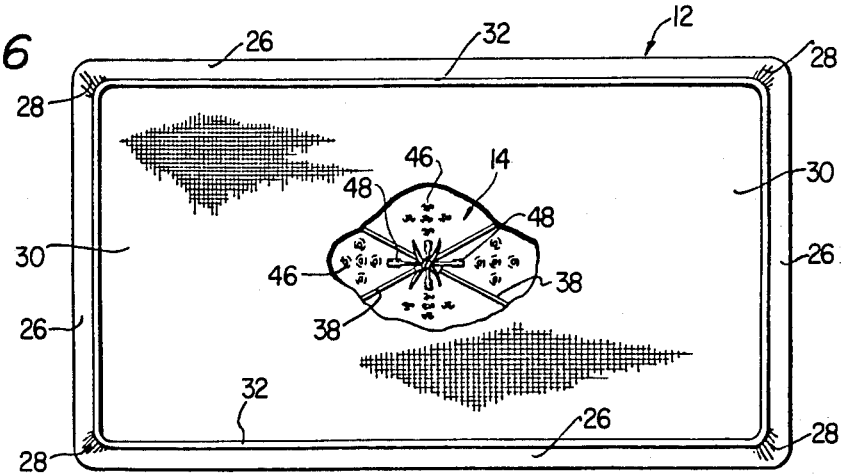
FIG. 6 is a bottom view of the bed tent of FIG. 1 illustrating the manner in which the base portion of the bed tent is fitted around a conventional mattress and wherein a portion of the mattress is broken away so as to permit viewing of the upper interior portion of the canopy. Like numerals are employed to designate like members throughout the specification and all figures of the drawing.

Referring to FIGS. 1, 5 and 6, means 48 are preferably provided within the upper interior portion 14 for use in maintaining the desired positional alignment of frame members 38 with respect thereto. As shown in FIGS. 1, 5 and 6, means 48 comprise ties connected to canopy portion 14 by stitching or by some other similarly effective fastening means. Means 48 may not be required where canopy portion 14 is designed and constructed as a self-supporting structure.

Figure 2:
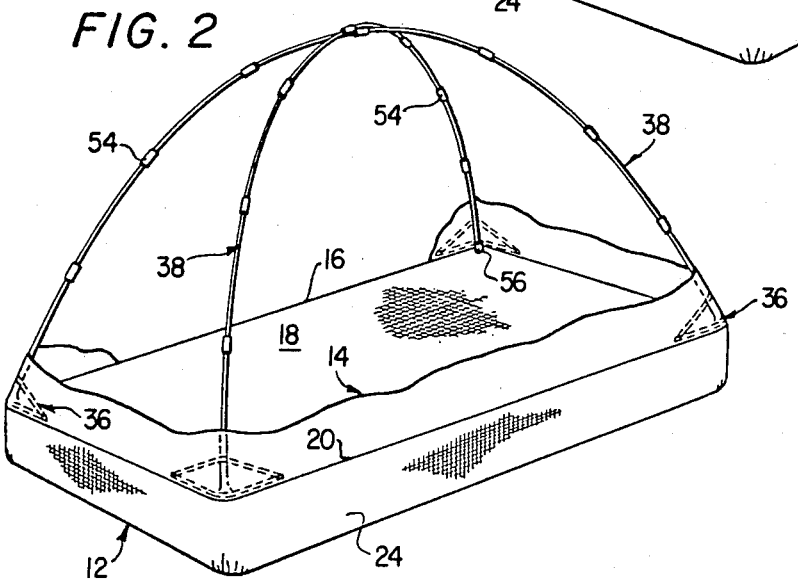
FIG. 2 depicts a rear perspective view of the bed tent of the invention in which the canopy portion is cut away to depict the frame members disposed within the canopy portion which maintain the canopy portion in a substantially upright position over the mattress.
Figure 3:
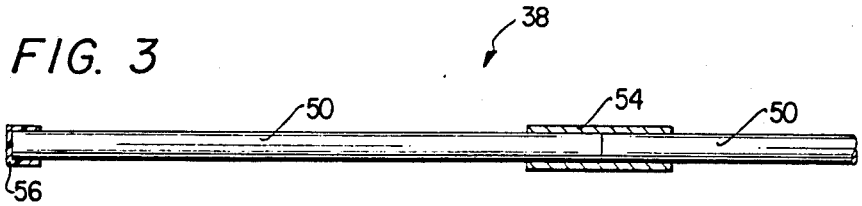
FIG. 3 is a detailed view depicting one end of a frame member suitable for use in supporting the canopy portion of the subject tent bed in a substantially upright position over the mattress.
Figure 4:
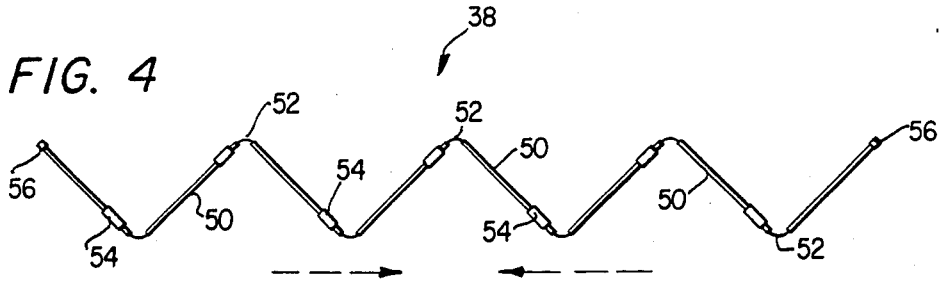
FIG. 4 depicts a preferred frame member for use in supporting the canopy portion of the subject bed tents in a partially collapsed position.

Referring to FIGS. 2, 3 and 4, each of frame members 38 is preferably flexible enough to be easily installed within bed tent 10 but rigid enough to maintain canopy portion 14 in its desired upright portion. According to the embodiment of the invention shown in FIGS. 2, 3 and 4, each frame member 38 comprises a plurality of tubular fiberglass members 50 interconnected by a continuous elastomeric cord 52. Sleeves 54 preferably frictionally engage tubular members 50 to provide a substantially rigid connection between adjacent tubular members 50 whenever frame member 38 is in its extended position. End caps 56 are preferably constructed of rubber, plastic or the like and are intended to reduce abrasion or tearing of the material of either base portion 12 or canopy portion 14 at corners 38. Frame members 38 as shown in FIGS. 2, 3 and 4 are preferred for use in bed tent 10 because they are easily collapsible to a length which can be more conveniently packed or carried. Nevertheless, it will be understood and appreciated that flexible dowels, fiberglass rods, graphite rods, metallic rods and the like may also be used within the scope of the invention. The frame members 50 are interconnected to form a framework defining the interior dimensions of the tent. With the framework inserted between the canopy 14 and the top surface of the mattress and the bottom portion 12 snugly secured to the mattress, the framework is secured in position and the entire assembly held in fixed position. The framework thus supports the canopy and is itself held in position by the canopy, the base portion and the mattress.

Other alterations and modifications of the invention will become apparent to those of ordinary skill in the art having the benefit of the drawing and the description contained herein, and it is intended that the present invention be limited only by the scope of the appended claims.

What is claimed:

1. A bed tent for providing an enclosure over a conventional mattress having a top surface, a bottom surface and side surfaces defining a peripheral edge comprising:

(a) canopy means adapted to define an enclosure above a conventional mattress having a top surface, a bottom surface and side surfaces defining a peripheral edge, said canopy means having an open base adapted to be coextensive with the peripheral edge of said mattress and said canopy means including a recloseable entry for providing ingress and egress for a user;

(b) elongated flexible frame members adapted to support said canopy means over said mattress when positioned between said top surface of said mattress and said canopy means by engaging the top surface of said mattress and being held in a fixed position by said canopy means and said mattress; and (c) securing means extending from the base of said canopy means adapted to attach said canopy means to said mattress, said securing means adapted to engage a limited portion of the bottom surface of said mattress.

2. A bed tent as defined in claim 1 wherein said securing means includes an elastomeric member adapted to draw the base of said canopy means around said mattress and thereby snugly secure said flexible frame to said mattress.

3. A bed tent as defined in claim 1 including reinforcing means in said canopy means adjacent ends of said frame members for receiving the ends of said frame members thereagainst.

4. The combination comprising:

(a) a conventional mattress having a top surface, a bottom surface and side surfaces;

(b) canopy means defining an enclosure above said mattress, said canopy means having an open base coextensive with the periphery defined by said side surfaces of said mattress and including a recloseable entry for providing ingress and egress for a user;

(c) elongated flexible frame members supporting said canopy means over said mattress positioned between said top surface of said mattress and said canopy means, said frame members engaging the top surface of said mattress and held in fixed position by said canopy means and said mattress; and (d) securing means extending from the base of said canopy means attaching said canopy means to said mattress, said securing means engaging a limited portion of the bottom surface of said mattress.

5. The combination defined in claim 4 wherein said securing means includes an elastomeric member drawing the base of said canopy means around said mattress and thereby snugly securing said flexible frame to said mattress.

6. The combination defined in claim 4 including reinforcing means in said canopy means adjacent ends of said frame members receiving the ends of said frame members thereagainst.

* * * * *

UNITED STATES PATENT AND TRADEMARK OFFICE

CERTIFICATE OF CORRECTION

PATENT NO. : 4,852,598

DATED : August 1, 1989

INVENTOR(S) : Harrell Griesenbeck

It is certified that error appears in the above-identified patent and that said Letters Patent is hereby corrected as shown below:

Column 2, line 1, "tentis" should read ---tent is---

Column 3, line 8, "nylong" should read ---nylon---

Column 5, line 19, "portion" should read ---position---

Signed and Sealed this

Twenty-second Day of May, 1990

*Attest:*

HARRY F. MANBECK, JR.

*Attesting Officer*

*Commissioner of Patents and Trademarks*